United States Patent [19]

Genovese et al.

[11] Patent Number: 4,756,042

[45] Date of Patent: Jul. 12, 1988

[54] FLOOR POLISHING MACHINE

[75] Inventors: Vincent P. Genovese, Fort Worth, Tex.; Richard F. Wulff, Maple Plains, Minn.

[73] Assignee: Southwest Manufacturers & Distributors, Inc., Fort Worth, Tex.

[21] Appl. No.: 47,033

[22] Filed: May 5, 1987

Related U.S. Application Data

[63] Continuation-in-part of Ser. No. 880,301, Jun. 30, 1986, abandoned.

[51] Int. Cl.[4] ..... A47L 11/162

[52] U.S. Cl. ..... 15/98; 15/49 R; 51/177

[58] Field of Search ..... 51/174, 177; 15/49 R, 15/50 R, 98 R

[56] References Cited

U.S. PATENT DOCUMENTS

| | | | |
|---|---|---|---|
| 2,727,262 | 12/1955 | Gerber | 15/49 R |
| 2,819,479 | 1/1958 | Sutton | 15/49 R |
| 3,615,820 | 10/1971 | Herrick . | |
| 4,358,868 | 11/1982 | Cook, Jr. | 51/177 |
| 4,542,551 | 9/1985 | Phillips | 51/177 |

FOREIGN PATENT DOCUMENTS

| | | | |
|---|---|---|---|
| 373613 | 5/1932 | United Kingdom | 51/177 |

OTHER PUBLICATIONS

Clark Brochure dated 8/83.
Advance Brochure dated Mar. 1983.
Southwest Part Sheet P882.

*Primary Examiner*—Roscoe V. Parker
*Attorney, Agent, or Firm*—Charles D. Gunter, Jr.

[57] ABSTRACT

A floor polishing machine is shown having a one piece, rotationally molded base formed from a synthetic, non conductive material. The base has a pad receiving portion integrally formed of the synthetic material for receiving a polishing pad. A pair of wheels are mounted on opposite sides of the base by means of an axle which passes transversely through the base. A motor compartment is formed in the rotationally molded base to contain an electric motor used to drive the pad.

4 Claims, 4 Drawing Sheets

FLOOR POLISHING MACHINE

CROSS REFERENCE TO RELATED APPLICATIONS:

The present application is a continuation-in-part of the earlier filed application of Vincent P. Genovese, Ser. No. 06/880,301, filed June 30, 1986, now abandoned, entitled "Floor Polishing Machine".

BACKGROUND OF THE INVENTION

1. Field of the Invention

The present invention relates to electrical floor polishing devices for commercial and residential use.

2. Description of the Prior Art

Many types of electrically powered floor polishing machines are presently sold in the marketplace. These machines typically feature a base or frame of a conductive material, such as steel or aluminum, onto which is bolted to an electric motor In some cases, a shroud of synthetic material covers a portion of the base. The motor is not typically received within a recess on the base and the metallic material of the base can be dented or can corrode with time. The metallic materials of the motor and base amplify the operating noise of the machine and also increase the overall weight of the machine. Because the prior art machines feature bases comprised at least partly of conductive materials, the possibility of an electrical shock exists.

The present invention has as its object a design for a floor polisher in which the base is provided from a non-conductive material which is less susceptible to damage or corrosion than were previously known designs.

Another object of the invention is a floor polisher design featuring a base of lighter weight material which acts as a sound deadener during operation.

Another object of the invention is a floor polisher design which saves manufacturing and assembly costs.

Another object of the invention is a floor polisher design in which the electrical system is totally encapsulated to eliminate the possibility of shock during use.

The above as well as additional objects, features, and advantages of the invention will become apparent in the following detailed description.

SUMMARY OF THE INVENTION

The floor polishing machine of the invention features a one piece, rotationally molded base formed from a synthetic, non-conductive material, the base having a pad receiving portion integrally formed of the synthetic material for receiving a polishing pad. A pair of wheels are mounted on opposite sides of the base by means of an axle which passes transversely through the base. A motor compartment formed in the rotationally molded base has an open top, vertical sidewalls, and a bottom wall. An electric motor is received within the motor compartment with the vertical sidewalls approximately containing the motor. Drive means connect the electric motor to the pad for driving the pad to polish a floor.

An electric cord runs from a control box on the handle, through the interior of the handle and through an opening in the molded base to a pair of motor capacitors. The capacitors are, in turn, connected to the electric motor. The capacitors are contained within recesses formed in the interior of the molded base, whereby the electrical components of the floor polishing machine are encapsulated by synthetic, non-conductive materials to reduce the possibility of electric shock.

DESCRIPTION OF THE PREFERRED EMBODIMENT

Figure 1:
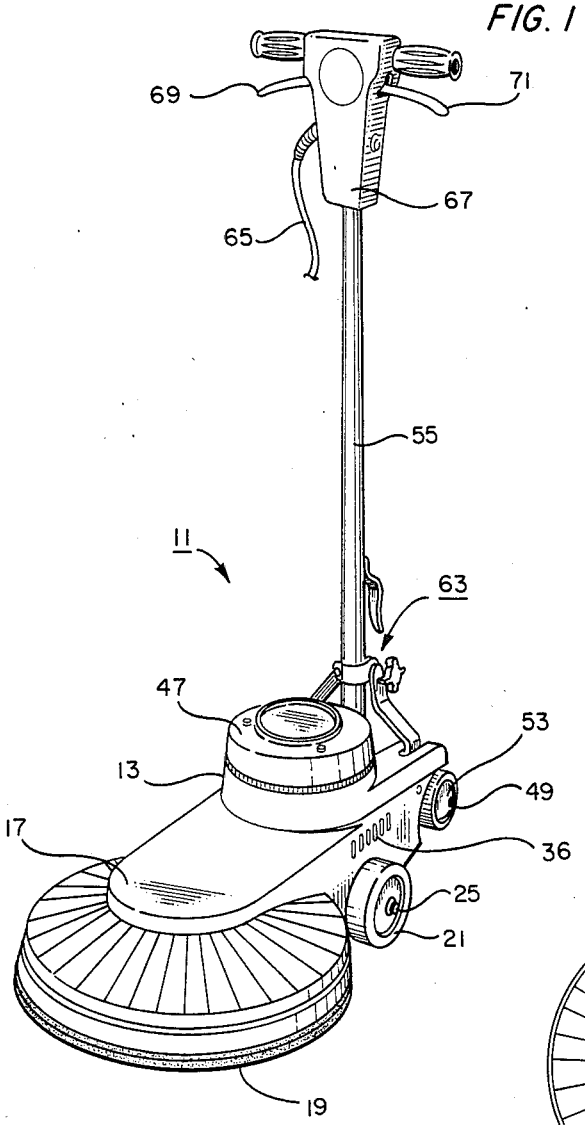
FIG. 1 is front perspective view of the floor polishing machine of the invention.
Figure 2:
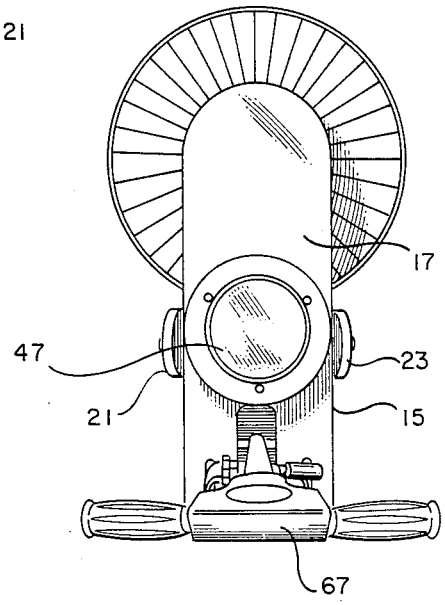
FIG. 2 is a top view of the floor polishing machine of FIG. 1.

FIG. 1 shows a floor polishing machine of the invention, designated generally as 11. The floor polishing machine 11 has a one piece, rotationally molded base 13 formed from a synthetic, non-conductive material. In rotational molding, the product is formed inside a closed mold or cavity where the mold is rotated biaxially in a heating chamber. To obtain the mold rotation in two planes perpendicular to each other, a spindle is rotated on a primary axis, while the mold is rotated on a secondary axis. In the loading stage, either liquid or powdered plastic is charged into a hollow mold. The mold halves are then clamped shut and moved into an oven where the loaded mold spins biaxially.

In the oven, heat penetrates the mold causing the plastic, if it is in the powder form, to become tacky and stick to the mold surface, or if it is in the liquid form, to start to gel. Usually, the heating is done by air or by liquid of high specific heat, such as molten salt. Since the mold continues to rotate while the heating is going on, the plastic will gradually become distributed evenly on the mold cavity walls through gravitational force. As the cycle continues, the synthetic material melts completely and forms a homogeneous layer of molten plastic.

When the parts have been formed, the mold is moved to a cooling chamber where cooling is accomplished by either a cold spray of water and/or forced air or liquid circulation inside the mold. The mold continues to be rotated during the cooling cycle. Additional details on rotational molding can be found in the Plastics Engineering Handbook of the Society of Plastics, Inc., 4th Edition, Ed. J. Frados, Nostrand-Reinhold Publishers.

Figure 4:
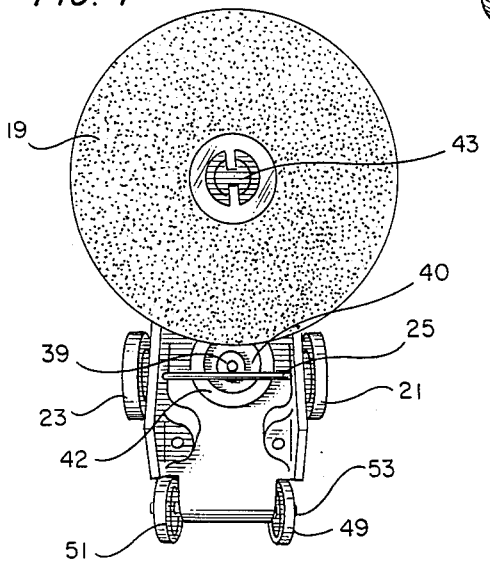
FIG. 4 is a bottom view of the floor polishing machine showing the polishing pad.
Figure 6:
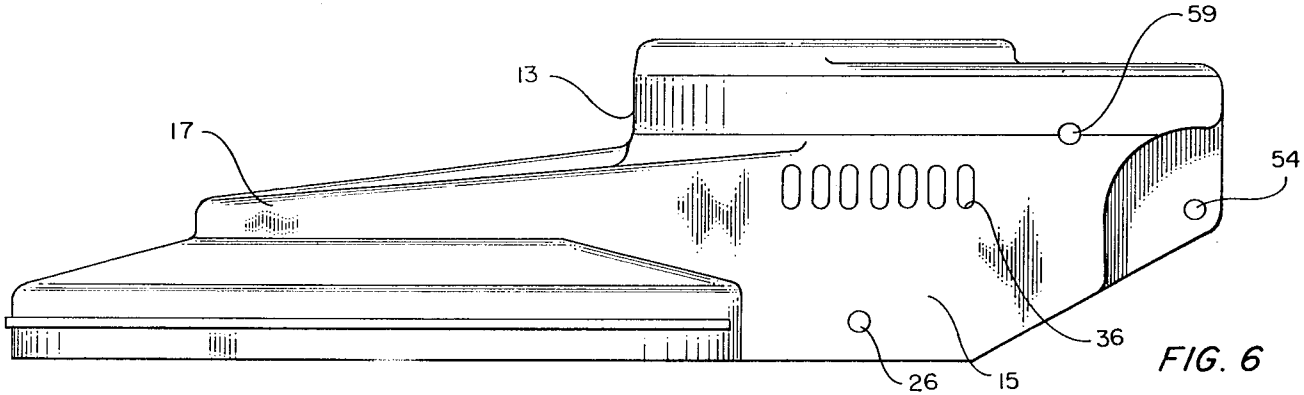
FIG. 6 is a side view, in profile, of the rotationally molded base of FIG. 5.

As shown in FIG. 6, the one piece base 13 has a body portion 15 and a forwardly projecting pad receiving portion 17 integrally formed of the synthetic material for receiving a polishing pad 19 (FIG. 4). As shown in FIGS. 1 and 4, a pair of primary wheels 21, 23 are mounted on opposite sides of the base 13 by means of an axle 25 which passes transversely through an opening 26 (FIG. 6) in the base 13. The axle 25 and primary wheels 21,23 together form a pivot point or pivot axis between the body portion 15 and forwardly projecting pad receiving portion 17 about which the pad can be pivoted for raising and lowering the pad with respect to the floor.

Figure 3:
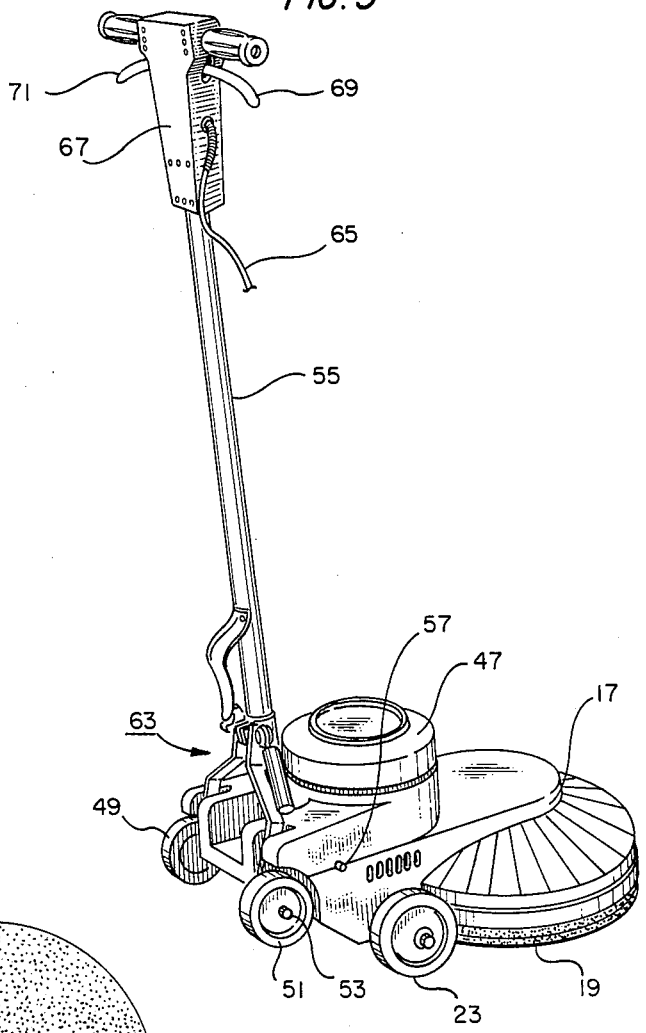
FIG. 3 is a rear view of the machine of FIG. 1.
Figure 5:
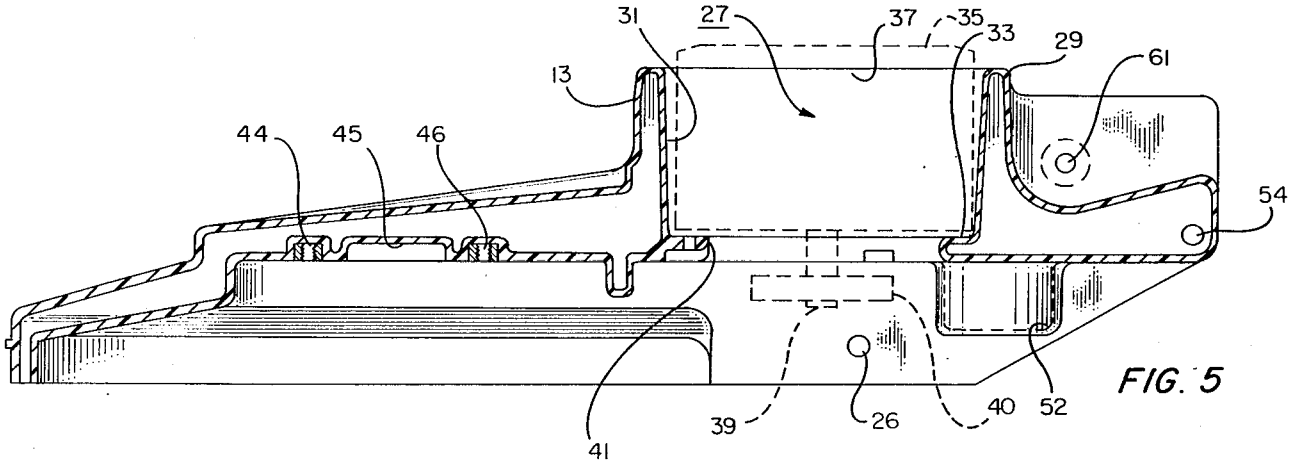
FIG. 5 is a side cross-sectional view of the rotationally molded base of the invention.

As best seen in FIG. 5, a generally cylindrical motor compartment (designated as 27) is formed in the rotationally molded base 13. The compartment is formed with an open top 29, vertical sidewalls 31, and a bottom wall 33. The open top 29 and vertical sidewalls 31 form a recess of a given depth for receiving an electric motor 35 (shown in dotted lines in FIG. 5) having an exterior which conforms to the shape of the motor compartment 27. The exterior of the motor 35 is of a selected height and width so that the depth of the motor compartment 27 is greater than half the height of the motor 35. Preferably, the depth of the motor compartment 27 is approximately the height of the motor 35. That is, the total height of the motor 35 extends to approximately the mouth 37 of the motor compartment 27. In this way, as shown in FIGS. 1 and 3, the electric motor is received within the compartment with the vertical sidewalls 31 approximately containing the motor.

An electric motor 35 of the type under consideration is commercially available from Southwest Manufacturers & Distributors, Inc. of Fort Worth, Tex., as a 1½ horsepower, 115 volt, 1200 r.p.m. "pancake" style motor and has generally cylindrical exterior sidewalls which allow it to be snugly received within the motor compartment 27. Louvers 36 are provided on the side of the base 13 to ventilate the motor compartment 27.

The motor has a driven shaft 39 (FIG. 4) which extends vertically through an opening 41 provided in the bottom wall 33 in the base. The driven shaft 39 is connected by suitable drive means, such as a pulley 40 and drive belt 42, to a similar pulley carried on a rotatable shaft 43 mounted in a bearing recess 45 of the pad receiving portion 17. Locator holes 44, 46 are provided for positioning a bearing assembly such as the 88A-1 bearing block assembly which is commercially available from Southwest Manufacturers & Distributors, Inc. The rotatable shaft 43 is used to drive pad 19 to polish a floor.

Figure 7:
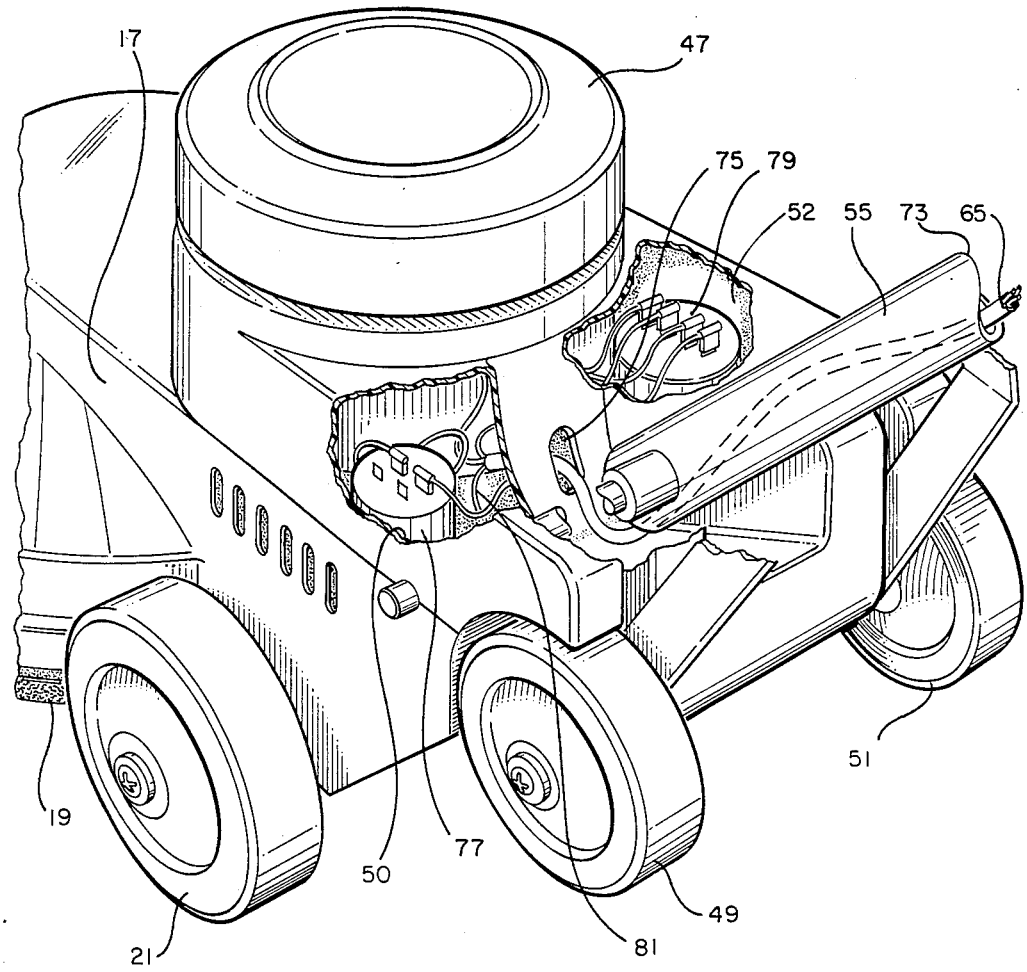
FIG. 7 is a partial rear view of the floor polishing machine with portions broken away to show the electrical components.

As shown in FIG. 7, the molded base 13 also includes a pair of vertical recesses 50,52, each of which is adapted to receive an electrical capacitor, as will be described.

A cap 47 of a synthetic material can be provided for covering the open top of the motor compartment 27 when the electric motor 35 is installed within the compartment, whereby the electric motor is completely contained within the motor compartment 27.

As shown in FIGS. 3 and 4, a pair of auxiliary wheels 49, 51 are mounted on opposite sides of the base 13 by means of an axle 53 which passes transversely through an opening 54 (FIG. 6) in the base 13. The auxiliary wheel axle 53 is located to the rear of the primary wheel axle 25, distant the pad receiving portion 17, and in a vertical plane generally parallel to that of the primary wheel axle 25. The horizontal plane of the auxiliary wheel axle 53 is above the horizontal plane of the primary wheel axle 25.

A handle 55 is pivotally mounted on the base 13 by a transverse bar 57 (FIG. 3) which passes through openings 59,61 and through the handle 55. An adjustable clamp 63, commercially available and known to those in the industry, can be used to position the handle 55 at different pivotal locations during use. A source of electrical current is connected by cord 65 to a control box 67 on the handle and from the control box 67 through the handle 55 to the electric motor 35. Levers 69,71 operate a conventional switch within the control box 67 to turn the motor on and off.

As shown in FIG. 7, the electrical cord 65 runs through the interior 73 of the handle 55 and through an opening 75 in the molded base 13 to a pair of starting capacitors 77,79. The capacitors 77,79 are received within the vertical recesses 50,52 provided in the interior of the molded base. Capacitor 77 is a 340 MFD capacitor and capacitor 79 is a 60 MFD capacitor. Wiring 81 connects the capacitors and the electric motor 35 in the conventional manner. As seen in FIG. 7, the capacitors 77,79 and associated electrical wiring 81 are contained within the interior of the molded base, whereby the electrical components of the floor polishing machine are encapsulated by synthetic, non-conductive materials to reduce the possibility of electrical shock. Because of the stored energy in the starting capacitors 77,79, it is particularly advantageous that they be isolated from metal components and encapsulated in the base.

An invention has been provided with several advantages. The floor polishing machine of the invention is made with a one piece rotationally molded base which is lighter in weight and less subject to damage and corrosion than metallic materials. The recessed motor compartment contains the electric motor and deadens the operating noise of the machine. The non-conductive nature of the base and encapsulated electrical system insures safety from electrical hazards, even when the device is being operated on wet floors.

While the invention has been described in only one of its forms, it should be apparent to those skilled in the art that it is not so limited, but is susceptible to various changes and modifications without departing from the spirit thereof.

I claim:

1. A floor polishing machine, comprising:

a one piece, rotationally molded base formed from a synthetic, non-conductive material, the base having a pad receiving portion integrally formed of the synthetic material for receiving a polishing pad;

a pair of wheels mounted on opposite sides of the base by means of an axle which passes transversely through the base;

a motor compartment formed in the rotationally molded base, the compartment being formed with an open top, vertical sidewalls, and a bottom wall;

an electric motor received with the motor compartment with the vertical sidewalls of the motor compartment approximately containing the motor;

drive means connecting the electric motor to the pad for driving the pad to polish a floor; and a cap formed of a synthetic material for covering the open top of the motor compartment when the electric motor is installed within the compartment, whereby the electric motor is completely contained within the motor compartment.

2. A floor polishing machine, comprising:

a one piece, rotationally molded base formed from a synthetic, non-conductive material, the base having a pad receiving portion integrally formed of the synthetic material for receiving a polishing pad, an interior, and at least one electric cord opening;

a pair of wheels mounted on opposite sides of the base by means of an axle which passes transversely through the base;

a handle extending outwardly from the base, the handle having a hollow interior and being pivotable between raised and lowered positions;

a motor compartment formed in the rotationally molded base, the compartment being formed with an open top, vertical sidewalls, and a bottom wall;

an electric motor received within the motor compartment with the vertical sidewalls of the motor compartment approximately containing the motor;

drive means connecting the electric motor to the pad for driving the pad to polish a floor;

an electric cord running through the interior of the handle and through the cord opening provided in the molded base to an electrical capacitor, the electrical capacitor being contained within a recess provided in the interior of the molded base and being electrically wired to the electric motor, whereby the capacitor and motor are encapsulated by the synthetic, non-conductive material of the molded base; and a cap formed of a synthetic material for covering the open top of the motor compartment when the electric motor is installed within the compartment, whereby the electric motor is completely contained within the motor compartment.

3. A floor polishing machine, comprising:

a one piece, rotationally molded base formed from a synthetic, non-conductive material, the base having a body portion and a forwardly projecting pad receiving portion integrally formed of the synthetic material for receiving a polishing pad;

a pair of wheels mounted on opposite sides of the base by means of an axle which passes transversely through the base;

a generally cylindrical motor compartment formed in the rotationally molded base, the compartment being formed with an open top, vertical sidewalls, and a bottom wall, the vertical sidewalls defining a depth for the motor compartment;

an electric motor having an exterior of a selected height and width which conforms to the shape of the motor compartment, the depth of the motor compartment being greater than half the height of the electric motor whereby the electric motor is received within the motor compartment with the vertical sidewalls of the motor compartment approximately containing the motor, the electric motor having a driven shaft which extends vertically through an opening in the motor compartment bottom wall;

drive means connecting the driven shaft of the electric motor to the pad for driving the pad to polish a floor; and a cap formed of a synthetic material for covering the open top of the motor compartment when the electric motor is installed within the compartment, whereby the electric motor is completely contained within the motor compartment.

4. A floor polishing machine having an encapsulated electrical system for eliminating the danger of electrical shock during use, comprising:

a one piece, rotationally molded base formed from a synthetic, non-conductive material, the base having a body portion and a forwardly projecting pad receiving portion integrally formed of the synthetic material for receiving a polishing pad, an interior, and at least one electric cord opening;

a pair of primary wheels mounted on opposite sides of the base by means of an axle which passes transversely through the base, the axle and primary wheels forming a pivot point between the body portion and pad receiving portion about which the pad can be pivoted for raising and lowering the pad with respect to the floor;

a handle extending outwardly from the base, the handle having a hollow interior and being pivotable between raised and lowered positions;

a generally cylindrical motor compartment formed in the rotationally molded base, the compartment being formed with an open top, vertical sidewalls, and a bottom wall, the vertical sidewalls defining a depth for the motor compartment;

an electric motor having an exterior of a selected height and width which conforms to the shape of the motor compartment, the depth of the motor compartment being greater than half the height of the electric motor, whereby the electric motor is received within the motor compartment with the vertical sidewalls of the motor compartment approximately containing the motor, the electric motor having a driven shaft which extents vertically through an opening in the motor compartment bottom wall;

drive means connecting the driven shaft of the electric motor to the pad for driving the pad to polish a floor;

a pair of auxiliary wheels mounted on opposite sides of the base by means of an axle which passes transversely through the base, the auxiliary wheel axle being located to the rear of the primary wheel axle, distant the pad receiving portion, and in a plane generally parallel to that of the primary wheel axle;

an electric cord running through the interior of the handle and through the cord opening provided in the molded base to an electrical capacitor, the electrical capacitor being contained within a recess provided in the interior of the molded base and being electrically wired to the electric motor, whereby the capacitor and motor are encapsulated by the synthetic, non-conductive material of the molded base;and a cap formed of a synthetic material for covering the open top of the motor compartment when the electric motor is installed within the compartment, whereby the electric motor is completely contained within the motor compartment.

* * * * *